US007669405B2

(12) United States Patent
Pinard et al.

(10) Patent No.: US 7,669,405 B2
(45) Date of Patent: Mar. 2, 2010

(54) SHAPED WALLS FOR ENHANCEMENT OF DEFLAGRATION-TO-DETONATION TRANSITION

(75) Inventors: Pierre Francois Pinard, Delmar, NY (US); Venkat Eswarlu Tangirala, Niskayuna, NY (US); Adam Rasheed, Glenville, NY (US); Anthony John Dean, Scotia, NY (US); Ronald Scott Bunker, Niskayuna, NY (US); David Michael Chapin, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 920 days.

(21) Appl. No.: 11/315,407

(22) Filed: Dec. 22, 2005

(65) Prior Publication Data

US 2007/0144179 A1 Jun. 28, 2007

(51) Int. Cl.
*F02K 5/02* (2006.01)

(52) U.S. Cl. ..... 60/247; 60/39.38; 60/39.76

(58) Field of Classification Search ..... 60/247, 60/39.38, 39.76, 752–760, 39.77, 39.78, 60/248, 249; 431/1, 353
See application file for complete search history.

(56) References Cited

U.S. PATENT DOCUMENTS 3,263,418 A * 8/1966 Lange et al. ..... 60/247
3,674,409 A * 7/1972 Desty et al. ..... 431/1
4,269,032 A * 5/1981 Meginnis et al. ..... 60/754
5,833,450 A * 11/1998 Wunning ..... 431/215
6,098,397 A * 8/2000 Glezer et al. ..... 60/772
6,644,921 B2 11/2003 Bunker et al. ..... 416/97 R
6,840,519 B2 1/2005 Dinc et al. ..... 277/413
6,877,310 B2 4/2005 Leyva ..... 60/247
2003/0182927 A1 * 10/2003 Leyva ..... 60/247
2004/0079082 A1 * 4/2004 Bunker ..... 60/752
2005/0210879 A1 9/2005 Murayama et al. ..... 60/776
2006/0096293 A1 * 5/2006 Norris et al. ..... 60/776
2007/0137172 A1 * 6/2007 Rasheed et al. ..... 60/39.76

OTHER PUBLICATIONS

Adam Rasheed et al.; "Experimental Investigations of an Axial Turbine Driven by a Multi-Tube Pulsed Detonation Cumbustor System"; 41st AIAA/ASME/SAE/ASEE Joint Propulsion Conference, Jul. 10-13, 2005, Tucson, AZ; pp. 1-13.

* cited by examiner

*Primary Examiner*—Michael Cuff
*Assistant Examiner*—Phutthiwat Wongwian
(74) *Attorney, Agent, or Firm*—Francis T. Coppa

(57) ABSTRACT

A detonation chamber for a pulse detonation combustor including: a plurality of dimples disposed on at least a portion of an inner surface of the detonation chamber wherein the plurality of dimples enhance a turbulence of a fluid flow through the detonation chamber.

15 Claims, 4 Drawing Sheets

Circumferential spacing

SHAPED WALLS FOR ENHANCEMENT OF DEFLAGRATION-TO-DETONATION TRANSITION

BACKGROUND

The present disclosure generally relates to cyclic pulsed detonation combustors (PDCs) and more particularly, the enhanced mixing and turbulence levels of the fuel-air mixture and flame kernel in order to promote the deflagration-to-detonation transition process.

In a generalized pulse detonation combustor, fuel and oxidizer (e.g., oxygen-containing gas such as air) are admitted to an elongated combustion chamber at an upstream inlet end. An igniter is used to initiate this combustion process. Following a successful transition to detonation, a detonation wave propagates toward the outlet at supersonic speed causing substantial combustion of the fuel/air mixture before the mixture can be substantially driven from the outlet. The result of the combustion is to rapidly elevate pressure within the combustor before substantial gas can escape through the combustor exit. The effect of this inertial confinement is to produce near constant volume combustion. Such devices can be used to produce pure thrust or can be integrated in a gas-turbine engine. The former is generally termed a pure thrust-producing device and the latter is termed a hybrid engine device. A pure thrust-producing device is often used in a subsonic or supersonic propulsion vehicle system such as rockets, missiles and afterburner of a turbojet engine. Industrial gas turbines are often used to provide output power to drive an electrical generator or motor. Other types of gas turbines may be used as aircraft engines, on-site and supplemental power generators, and for other applications.

The deflagration-to-detonation process begins when a fuel-air mixture in a chamber is ignited via a spark or other source. The subsonic flame generated from the spark accelerates as it travels along the length of the chamber due to various chemical and flow mechanics. As the flame reaches critical speeds, "hot spots" are created that create localized explosions, eventually transitioning the flame to a super sonic detonation wave. The DDT process can take up to several meters of the length of the chamber, and efforts have been made to reduce the distance required for DDT by using internal obstacles in the flow. The problem with obstacles for cyclic detonation devices is that they have relatively high pressure drop, and require cooling. Shaped-wall features, which reduce run-up to detonation that are integrated with the wall for cooling and have low pressure drop are desirable. Shaped walls will herein include, but not be limited to, geometric features including dimples, protrusions, local recesses, cross-hatching, depressions, and ridges.

As used herein, a "pulse detonation combustor" is understood to mean any device or system that produces pressure rise, temperature rise and velocity increase from a series of repeating detonations or quasi-detonations within the device. A "quasi-detonation" is a supersonic turbulent combustion process that produces pressure rise, temperature rise and velocity increase higher than pressure rise, temperature rise and velocity increase produced by a deflagration wave. Embodiments of pulse detonation combustors include a fuel injection system, an oxidizer flow system, a means of igniting a fuel/oxidizer mixture, and a detonation chamber, in which pressure wave fronts initiated by the ignition process coalesce to produce a detonation wave. Each detonation or quasi-detonation is initiated either by external ignition, such as spark discharge or laser pulse, or by gas dynamic processes, such as shock focusing, autoignition or by another detonation (cross-fire). The geometry of the detonation combustor is such that the pressure rise of the detonation wave expels combustion products out the pulse detonation combustor exhaust to produce a thrust force. Pulse detonation combustion can be accomplished in a number of types of detonation chambers, including shock tubes, resonating detonation cavities and tubular/tuboannular/annular combustors. As used herein, the term "chamber" includes pipes having circular or non-circular cross-sections with constant or varying cross sectional. Exemplary chambers include cylindrical tubes, as well as tubes having polygonal cross-sections, for example hexagonal tubes.

BRIEF SUMMARY

Exemplary embodiments of shaped walls include a detonation chamber for a pulse detonation combustor including: a plurality of dimples disposed on at least a portion of an inner surface of the detonation chamber wherein the plurality of dimples enhance a turbulence of a fluid flow through the detonation chamber Exemplary embodiments also include a pulse detonation engine including: a pulse detonation combustor; a gas supply section for feeding a gas into the detonation chamber; a fuel supply section for feeding a fuel into the detonation chamber; an igniter for igniting a mixture of the gas and the fuel in the detonation chamber, wherein the pulse detonation combustor comprises a plurality of dimples disposed on an inner surface of the detonation chamber and a protrusion which is integral to the inner surface of the detonation chamber, extending into the detonation chamber; and wherein the plurality of dimples enhance a turbulence of a fluid flow through the detonation chamber.

Further exemplary embodiments include a deflagration-to-detonation transition method including: drawing an air-fuel mixture into a detonation chamber comprising a plurality of dimples disposed on an inner surface of the detonation chamber and a plurality protrusions disposed on the inner surface of the detonation chamber extending into the pulse detonation combustor; igniting the air-fuel mixture; tripping a flame resulting from igniting the air-fuel mixture; increasing the turbulent kinetic energy in the flame with the plurality of dimples; and obstructing the flame with at least a first portion of the protrusions effective to initiate detonation.

Other exemplary embodiments include a method for forming a detonation chamber including: manipulating a textured sheet to form a chamber including an inlet, an outlet, a selective combination of a plurality of dimples and a plurality of protrusions.

BRIEF DESCRIPTION OF THE DRAWINGS

Referring to the exemplary drawings wherein like elements are numbered alike in the several Figures.

DETAILED DESCRIPTION

Figure 1:
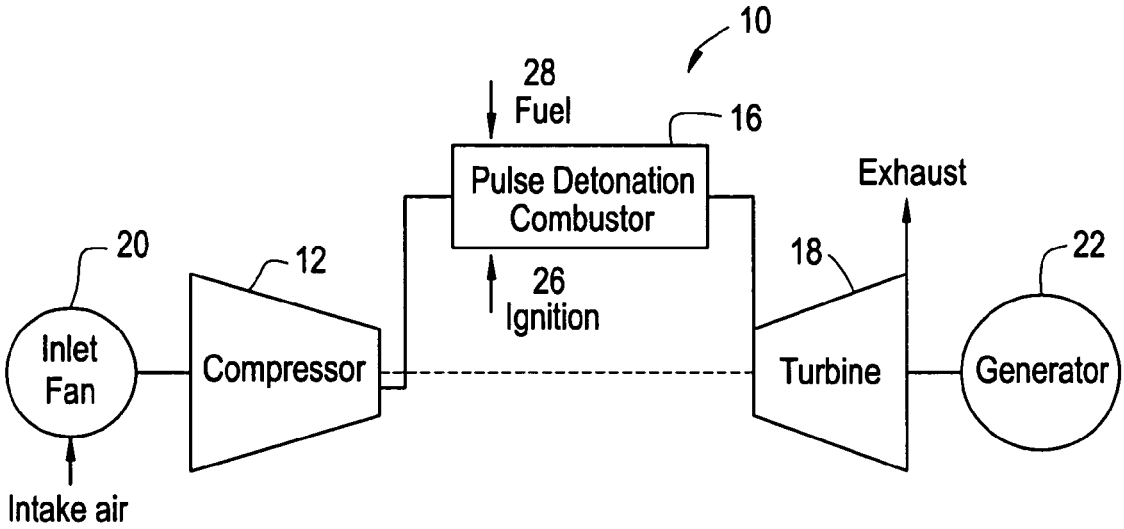
FIG. 1 is a schematic view illustrating a structure of a pulse detonation engine system for a hybrid engine.
Figure 2:
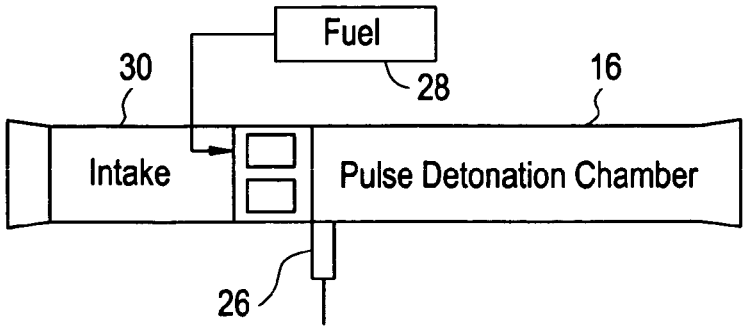
FIG. 2 is a schematic view illustrating a structure of a detonation chamber section of FIG. 1.

Referring now to FIGS. 1 and 2, various pulse detonation engine systems 10 convert kinetic and thermal energy of the exhausting combustion products into motive power necessary for propulsion and/or generating electric power. FIG. 2 shows a pulse detonation combustor in a pure supersonic propulsion vehicle. The pulse detonation combustor in a hybrid engine concept 10, shown in FIG. 1, or a pure pulse detonation engine shown in FIG. 2, includes a detonation chamber 16 having a gas supply section (e.g., an air valve) 26 for feeding a gas (e.g., oxidant such as air) into the detonation chamber 16, a fuel supply section (e.g., a fuel valve) 28 for feeding a fuel into the detonation chamber 16, and an igniter (for instance, a spark plug) 26 by which a mixture of gas combined with the fuel and air in the detonation chamber 16 is ignited.

In exemplary embodiments, air supplied from an inlet fan 20 and/or a compressor 12, which is driven by a turbine 18, is fed into the gas supply section 26 through an intake 30. Fresh air is filled in the detonation chamber 16, after purging combustion gases remaining in the detonation chamber 16 due to detonation of the fuel-air mixture from the previous cycle. After the purging the pulse detonation combustor 16, fresh fuel is injected into pulse detonation combustor 16. Then, the igniter 26 ignites the fuel-air mixture forming a flame, which accelerates down the pulse detonation combustor, finally transitioning to a detonation wave or a quasi-detonation wave. Due to the detonation combustion heat release, the gases exiting the pulse detonation combustor are at high temperature, high pressure and high velocity conditions, which expand across the turbine 18, located at the downstream of the pulse detonation combustor 16, thus generating positive work. For a hybrid engine application with the purpose of generation of power, the pulse detonation driven turbine 18 is mechanically coupled to a generator (e.g., a power generator) 22 for generating power output. For a hybrid engine application with the purpose of propulsion (such as the present aircraft engines), the turbine shaft is coupled to the inlet fan 20 and the compressor 12. In a pure pulse detonation engine application of the pulse detonation combustor shown in FIG. 2, which does not contain any rotating parts such as a fan or compressor/turbine/generator, the kinetic energy of the combustion products and the pressure forces acting on the walls of the propulsion system, generate the propulsion force to propel the system.

Figure 3A:
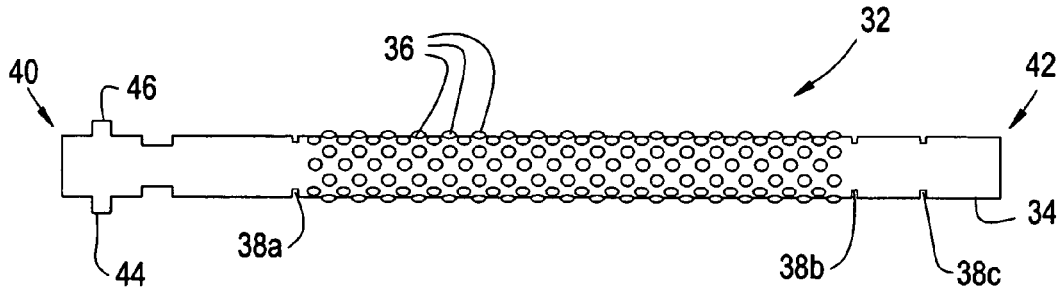
FIG. 3(*a*)-(*b*) is a diagram illustrating an improved pulse detonation combustor with shaped walls for deflagration-to-detonation transition enhancement in accordance with exemplary embodiments.
Figure 3B:
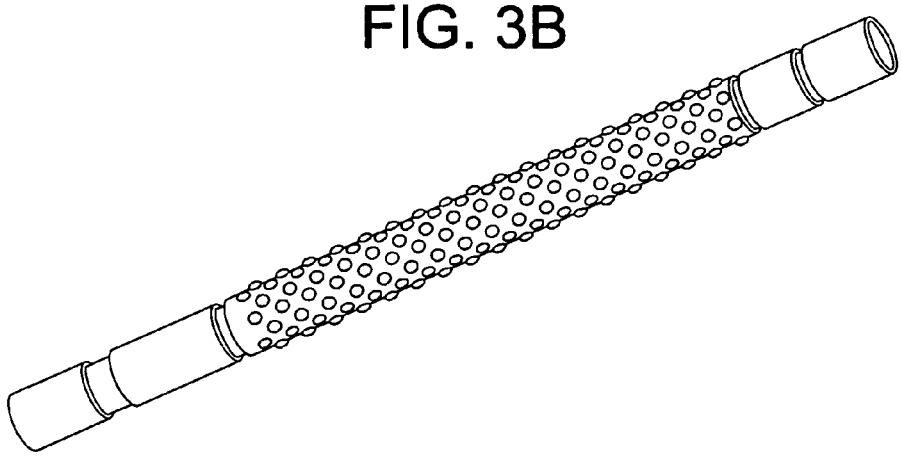

Turning now to FIG. 3*a* which shows an external view of the detonation chamber with shaped walls namely dimples and FIG. 3*b* which shows a view of the inside of the detonation tube with shaped walls namely dimples by removing the top 50% of the tube surface, an improved detonation chamber with shaped walls for deflagration-to-detonation transition enhancement is generally depicted as 32. The improved pulse detonation combustor 32 includes an inlet 40 and an outlet 42. The improved pulse detonation combustor 32 also includes shaped walls 34 having a plurality of dimples 36 and one or more protrusions 38(*a*)-(*c*). The protrusions 38(*a*)-(*c*) may be disposed on either or both ends of the improved detonation chamber 32 and extend into the detonation chamber. The inlet 40 includes both an air intake 44 and a fuel intake 46.

The plurality of dimples 36 on the inner surface of the improved detonation chamber 32 enhance the turbulent flame speed, and accelerate the turbulent flame, while limiting the total pressure loss in the pulse detonation combustor. The plurality of dimples 36 also enhance turbulence flame surface area by providing more volume, into which the flame can expand, compared to the flame surface area in a combustor with smooth walls. Contrary to the protrusions that constrict the flow, the plurality of dimples 36 can potentially result in a smaller pressure loss while generating the same levels of flame acceleration. However, a couple of protrusions were found to be necessary to affect the transition of the accelerating turbulent flame into a detonation wave. In addition, the pressure drop in the improved pulse detonation combustor was found to be considerably small when compared to the pressure drop in a pulse detonation combustor with only protrusions present (which is the current practice in achieving detonations in a pulse detonation combustor).

Figure 4:
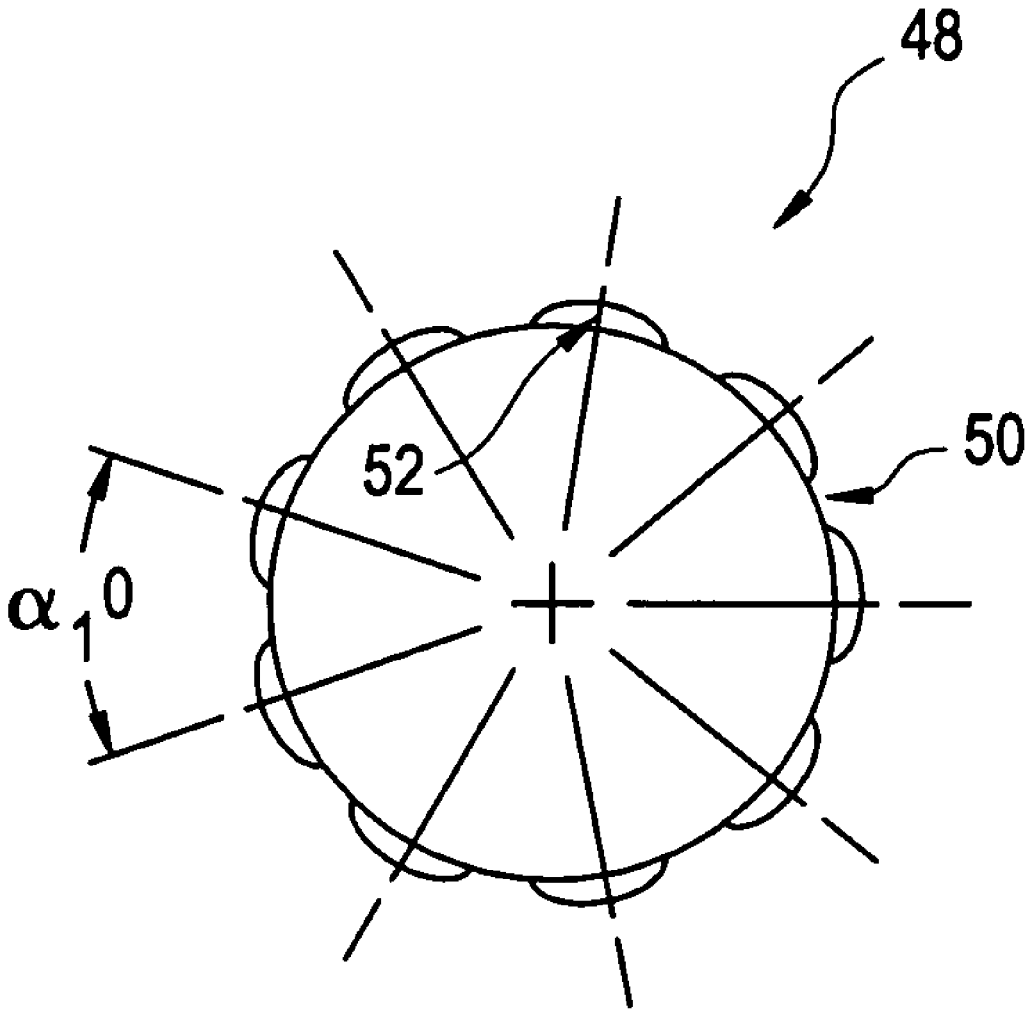
FIG. 4 is a cross section of an improved pulse detonation combustor with shaped walls for deflagration-to-detonation transition enhancement as depicted in FIG. 3.
Figure 5A:
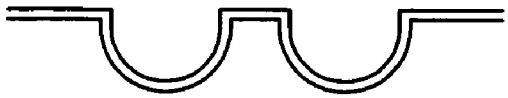
FIGS. 5(*a*)-(*d*) is a diagram illustrating various shapes of the shaped walls of the improved pulse detonation combustor for deflagration-to-detonation transition enhancement in accordance with exemplary embodiments.
Figure 5B:
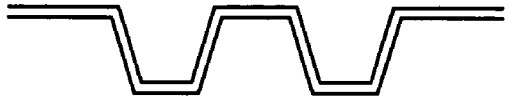
Figure 5C:
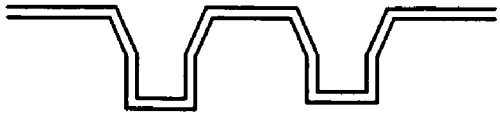
Figure 5D:
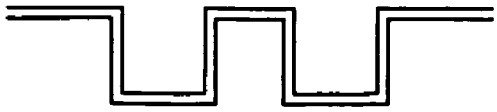

The plurality of dimples 36 may be arranged as depicted in FIGS. 4, and 5(*a*) through 5(*d*). In exemplary embodiments, the plurality of dimples 36 may be disposed in a number of rows and columns as depicted in FIG. 3(*a*) and 3(*b*), circumferentially spaced as depicted in FIG. 4 with the columns being spaced axially along the improved pulse detonation combustor 32, and the rows being spaced circumferentially along the improved pulse detonation combustor. Additionally, the number of rows and columns and the spacing between each may be varied to achieve detonations or quasi-detonations in varying fuel-air systems. In other exemplary embodiments, the plurality of dimples 36 may be disposed in a number of rows and columns with the dimples having staggered or inline arrangement along the axial direction. In further exemplary embodiments, the plurality of dimples 36 may have varying density of dimples on the walls of the pulse detonation combustor. In general, higher density of dimples which are closely spaced are found to be more effective in achieving successful detonations or quasi-detonations.

Turning now to FIG. 4, a cross section of an improved pulse detonation combustor is depicted generally as 48. The improved pulse detonation combustor 48 includes inner chamber 50 that has a plurality of dimples 52. The plurality of dimples 52 may be disposed in a wide variety of arrangements. In exemplary embodiments, the plurality of dimples 52 has a range of axial spacing of 0.375-0.75 inches. The circumferential spacing of the plurality of dimples 52 can vary from 25-50°. In an exemplary embodiment the plurality of dimples 52 are spaced circumferentially, by approximately 30 degrees (FIG. 4). In exemplary embodiments, the improved detonation chamber 48 includes a cooling system disposed inside of the outer chamber 54. The plurality of dimples 52 increases the surface area of the inner chamber 50 and therefore increases the cooling of the improved pulse detonation combustor wall, thereby ensuing the integrity of the pulse detonation combustor walls.

Further, the plurality of dimples may have varying diameters and depths. In exemplary embodiments the arrangement, diameter, depth of the plurality of dimples, the density of the dimples and the type of packing of the dimples (staggered vs inline arrangement and densely packed vs loosely packed depending on axial and radial spacing dimensions) may all be adjusted to achieve the desired turbulent flame acceleration in the improved pulse detonation combustor. In further exemplary embodiments, the shaped walls do not necessarily be confined to be of spherical features but can range from fractionally-spherical, conical frustrum, cubic or rectangular features, as shown in FIGS. 5(*a*) through 5(*d*). While one embodiment of size/spacing/orientation is provided, it will be understood that many relative scales can be used depending on the overall size of the tube.

As illustrated in FIGS. 3*a* and 3*b*, a set of protrusions 38(*a*)-38(*c*) can be disposed in the improved pulse detonation combustor 32 between the inlet 40 and the plurality of dimples 36. Stable flame ignition is promoted by the use of the 1st protrusion, 38(*a*). The second and third protrusions 38(*b*) and 38(*c*) facilitate transition of an accelerated turbulent flame into a detonation wave. The protrusions 38(*a*)-(*c*) may be orifice plates, rearward-facing steps or any other suitable obstruction which are integral parts of the inner surface of the pulse detonation combustor. The protrusions 38(*a*)-(*c*) enhance mixing between the fuel and the air and enhance spark initiation in the improved detonation chamber 32. Additionally, the protrusions 38(*a*)-(*c*) help create 'hot spots' during shock-to-flame interactions regime corresponding to the sonic/choked flow conditions of gases behind the leading combustion wave.

The improved detonation chamber 32 may be constructed in a variety of ways. In exemplary embodiments, a piece of sheet metal is shaped to include the plurality of dimples 36 and the protrusions 38. For example, a ball hammer may be used to create the plurality of dimples 36. The piece of sheet metal may then be rolled into form the improved detonation chamber 32. The improved detonation chamber 32 may also be formed through several other methods including, but not limited to, casting or molding. In exemplary embodiment, protrusions 38 are orifice plates that are welded into the improved detonation chamber 32.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A detonation chamber for a pulse detonation combustor comprising:

a plurality of dimples disposed in at least a portion of an inner surface of the detonation chamber to enhance a turbulence of a fluid flow through the detonation chamber, the inner surface being at a first distance from a central axis of the detonation chamber; and a first protrusion formed at a second distance from the central axis of the detonation chamber, the second distance being smaller than the first distance such that the first protrusion extends into the detonation chamber, wherein the first protrusion is disposed between the plurality of dimples and an inlet of the detonation chamber to promote stable flame ignition.

2. The detonation chamber of claim 1, further comprising a second protrusion and a third protrusion disposed on the inner surface of the detonation chamber between the plurality of dimples and the outlet to facilitate transition of an accelerated turbulent flame into a detonation wave.

3. The detonation chamber of claim 1, wherein the plurality of dimples are disposed in one or more circumferential rows and one or more axial columns along at least a portion of the inner surf ace of the detonation chamber.

4. The detonation chamber of claim 1, wherein the plurality of the dimples are uniformly spaced within each circumferential row and each axial column.

5. The detonation chamber of claim 1, wherein the plurality of dimples are disposed in a close packed arrangement.

6. The detonation chamber of claim 1, wherein the plurality of dimples have a uniform depth and a uniform width.

7. The detonation chamber of claim 1, wherein the plurality of dimples have various depths and various widths.

8. A detonation chamber of claim 1 with near-uniform thickness, wherein the plurality of dimples, serves to enhance heat transfer on the outer surface of the chamber.

9. A pulse detonation combustor comprising:

at least one detonation chamber having an inlet and an outlet;

a gas supply section for feeding a gas into the detonation chamber;

a fuel supply section for feeding a fuel into the detonation chamber;

an igniter for igniting a mixture of the gas and the fuel in the detonation chamber, wherein the detonation chamber comprises a plurality of dimples disposed in an inner surface of the detonation chamber to enhance a turbulence of a fluid flow through the detonation chamber, the inner surface being at a first distance from a central axis of the detonation chamber; and a first protrusion formed at a second distance from the central axis of the detonation chamber, the second distance being smaller than the first distance such that the first protrusion extends into the detonation chamber, wherein the first protrusion is disposed between the plurality of dimples and the inlet to promote stable flame ignition.

10. The pulse detonation combustor of claim 9, further comprising a second protrusion and a third protrusion disposed on the inner surface of the detonation chamber between the plurality of dimples and the outlet to facilitate transition of an accelerated turbulent flame into a detonation wave.

11. The pulse detonation combustor of claim 9, wherein the plurality of dimples are disposed in one or more circumferential rows and one or more axial columns along at least a portion of the inner surface of the detonation chamber.

12. The pulse detonation combustor of claim 9, wherein the plurality of the dimples are uniformly spaced within each circumferential row and each axial column.

13. The pulse detonation combustor of claim 9, wherein the plurality of dimples are disposed in a close packed arrangement.

14. The pulse detonation combustor of claim 9, wherein the plurality of dimples have a uniform depth and a uniform width.

15. The pulse detonation combustor of claim 9, wherein the plurality of dimples have various depths and various widths.

* * * * *